United States Patent [19]

Radigan

[11] 4,338,736

[45] Jul. 13, 1982

[54] RETAINING PIN ASSEMBLY FOR EARTHWORKING TOOL

[75] Inventor: Michael T. Radigan, Manhattan, Ill.

[73] Assignee: Caterpillar Tractor Co., Peoria, Ill.

[21] Appl. No.: 278,509

[22] PCT Filed: Mar. 16, 1981

[86] PCT No.: PCT/US81/00329

§ 371 Date: Mar. 16, 1981

§ 102(e) Date: Mar. 16, 1981

[51] Int. Cl.[3] ..... E02F 9/28

[52] U.S. Cl. ..... 37/142 A; 403/355; 411/479

[58] Field of Search ..... 37/142 R, 142 A; 403/355; 85/5 N, 8.3; 279/19.1

[56] References Cited

U.S. PATENT DOCUMENTS

| | | | |
|---|---|---|---|
| 3,526,435 | 9/1970 | Krekeler | 37/142 A X |
| 3,967,399 | 7/1976 | Heinold et al. | 37/142 A |
| 3,997,989 | 12/1976 | Stepe | 37/142 A |
| 4,050,172 | 9/1977 | Petersen | 37/142 A |
| 4,129,934 | 12/1978 | Gettman | 37/142 A X |

FOREIGN PATENT DOCUMENTS

| | | | |
|---|---|---|---|
| 2127951 | 12/1971 | Fed. Rep. of Germany | 37/142 A |

*Primary Examiner*—E. H. Eickholt

*Attorney, Agent, or Firm*—Claude F. White

[57] ABSTRACT

A retaining pin assembly (16) for securing a replaceable earthworking tool (14) to a support member (12) includes a spring type pin (36) and a coacting sleeve (40). The pin assembly (16) is insertable through generally aligned openings (30,22) in the tool (14) and support member (12) and functions to lock the tool (14) to the support member (12) and to force an end portion (28) of the tool (14) into contacting relationship with shoulders (18,20) of the support member (12). Earthworking apparatus, such as impact rockbreakers and rippers, generally include a replaceable tool mounted on a shank or support member. Unless the tool is forceably held in contacting relationship with the support member, the retaining pin, tool, and support member are subject to damage. The retaining pin assembly (16) of the present invention secures the tool (14) and support member (12) in contacting relationship and maintains a continuous locking force between the tool (14) and the supporting member (12).

10 Claims, 5 Drawing Figures

RETAINING PIN ASSEMBLY FOR EARTHWORKING TOOL

TECHNICAL FIELD

This invention relates generally to earthworking tools and more particularly to a retaining pin assembly which is used to lock a replaceable wear tool to a supporting member.

BACKGROUND ART

Earthworking tools are extensively used, in conjunction with earthmoving machines, in construction and earthworking operations. The earthworking tools are mounted on a shank or support member and are generally of the replaceable type. Periodical replacement is necessary since the tools are subject to extreme wear due to operation in conditions where they encounter rock, sand, and other types of abrasive earthen materials. In order to expedite the replacement of a worn tool with a new tool, various types of retaining pins have been used to secure the replaceable tool to the supporting member.

In order that minimum time is lost during the replacement of a worn tool, it is desirable that the retaining pin be easily and quickly removable and reinsertable. It is also desirable that the retaining pin be reusable to conserve materials and costs. Also, it is essential that the retaining pin apply a continuous force between the tool and the support member in order to hold the tool in firm contact with the support member.

One type of retaining pin for securing a tooth to an adapter is shown in U.S. Pat. No. 3,685,178, issued to Thomas A. Ratkowski on Aug. 22, 1972. This retaining pin includes a rigid metal member of rectangular cross-sectional shape, another metal member of less massive area, and a layer of resilient material bonded to and between the two metal members. The resilient material is preferably rubber, and in the installed conditions, is under compression to cause the tooth to be drawn up on the adapter.

The retaining pin in the above-identified patent requires considerable effort and time consuming operations to produce. It is composed of two metal parts which require separate machining operations, a rubber part which also requires some type of operation to produce apertures therein, and further requires a bonding operation to bond the various parts together. In view of the fact that the tooth and adapter, which uses the above-described pin, operates in severe earthworking conditions, the pin is subject to all type of environments, including dirt, sand, rock, mud, and water. Under these conditions, it is likely that the rubber member would have a short usable life. In addition, repeated loading or impacting of the tooth can cause deterioration of the rubber, loss of holding force, and possible loss of the tooth from the adapter.

The present invention is directed to overcoming one or more of the problems as set forth above.

DISCLOSURE OF THE INVENTION

In one aspect of the present invention, a retaining pin assembly for releasably securing an earthworking tool to a support member has a spring pin and a sleeve member. The pin and sleeve are insertable in generally aligned pin receiving openings in the tool and support member to lock them together and maintain a portion of the tool in forceable contact with the support member.

Earthworking apparatus, such as impact rock breakers and rippers, utilize a shank or support member which releasably supports a replaceable earthworking tool. The tool is locked to the support by some type of retaining pin. To prevent damage to the tool, support member, and pin, the tool should be held in forceable contact with the support member. The retaining pin assembly of the present invention uses the force of a compressed spring pin to lock the tool to the support member and to maintain a portion of the tool in forceable contact with the support member as long as the pin assembly is in the installed position.

BEST MODE FOR CARRYING OUT THE INVENTION

Figure 1:
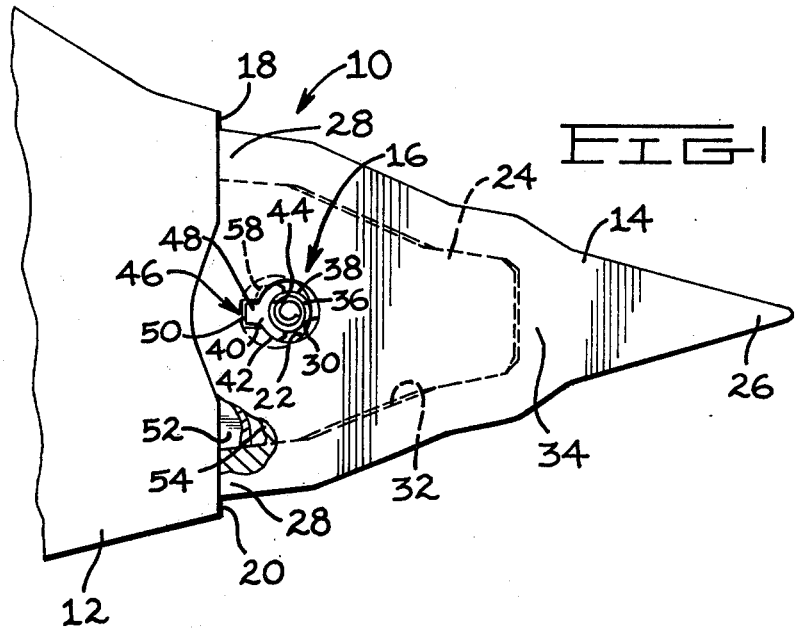
FIG. 1 is a diagrammatic side elevational view of an embodiment of the present invention, with the various members shown in the installed position.
Figure 2:
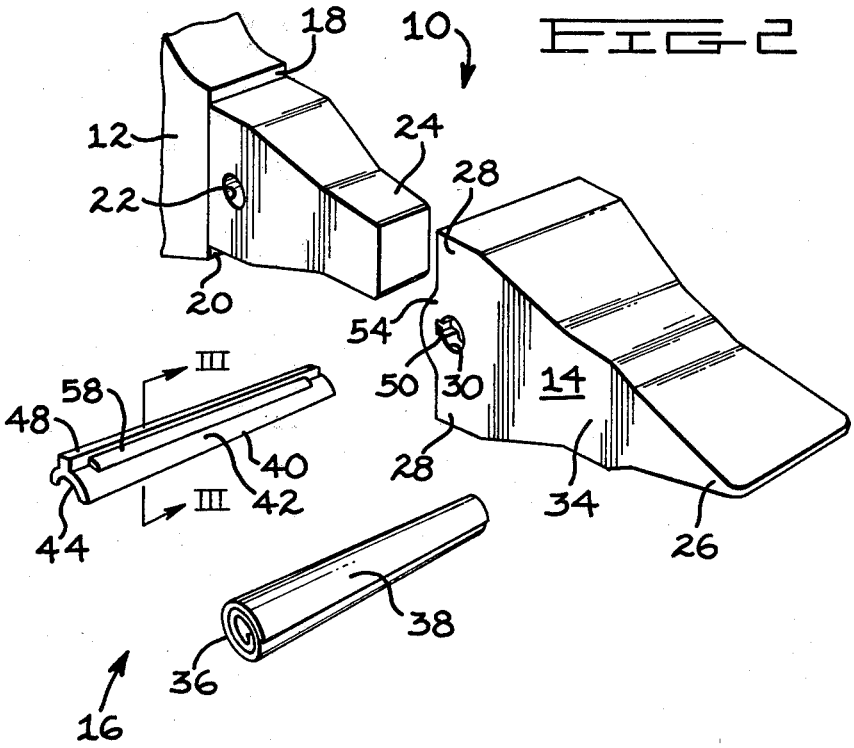
FIG. 2 is a diagrammatic exploded view of the various members shown in FIG. 1.

Referring to FIGS. 1 and 2 of the drawings, an earthworking apparatus 10 includes a tool supporting member 12, an earthworking tool 14, and a retaining pin assembly 16. Supporting member 12 has first and second shoulders 18 and 20, a pin receiving opening 22, and a nose portion 24. The tool 14 has first and second end portions 26 and 28, a pin receiving opening 30, and a cavity 32 which is closed at one end by a wall portion 34. The retaining pin assembly 16, which serves to connect the tool 14 to the supporting member 12, includes a spring type pin 36 having an outer surface 38, and a sleeve 40 having first and second surfaces 42 and 44 of arcuate configuration. In the installed position of the tool 14 on the supporting member 12, and the retaining pin assembly in place holding the tool 14 and supporting member 12 in forceable contact, the pin 36 is compressed between the pin receiving opening 22 of the supporting member 12 and the second surface 44 of the sleeve 40.

Means 46 are provided for maintaining the sleeve 40 against rotation about pin 36 when the retaining pin assembly is in place holding the tool 14 to the supporting member 12. Means 46 includes a key portion 48 formed on the first surface 42 of the sleeve 40 and a slot 50 formed in the earthworking tool 14. The key portion 48 preferably extends the full length of the sleeve 40. As is evident from FIG. 2, the tool 14 further includes first and second walls 52,54, and each wall preferably contains a slot 50 to receive the key portion 48 of sleeve 40.

Figure 3:
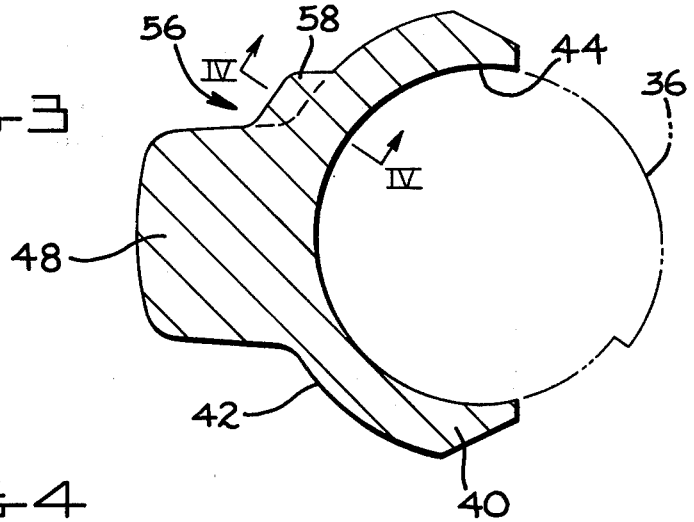
FIG. 3 is a cross-sectional view taken generally along the line III—III of FIG. 2.

Referring to FIG. 3, it can be seen that the key portion 48 extends radially outwardly from the first surface 42 of the sleeve 40 and is integrally formed with surface 42. As is also evident from FIG. 3, the sleeve 40 is of configuration to encompass between one-third to two-thirds of outer surface of the spring pin 36, which is shown in phantom line detail. This provides adequate contact between the second surface 44 and outer surface 38 of the pin 36, and between the first surface 42 and the walls of the pin opening 30, as shown in FIG. 1. A large area of contact between the sleeve 40 and the pin 36, and between the sleeve 40 and the walls of the pin openings 30 is important to keep the pin 36 compressed while the pin assembly 16 is in place holding the tool 14 to the supporting member 12.

Figure 4:
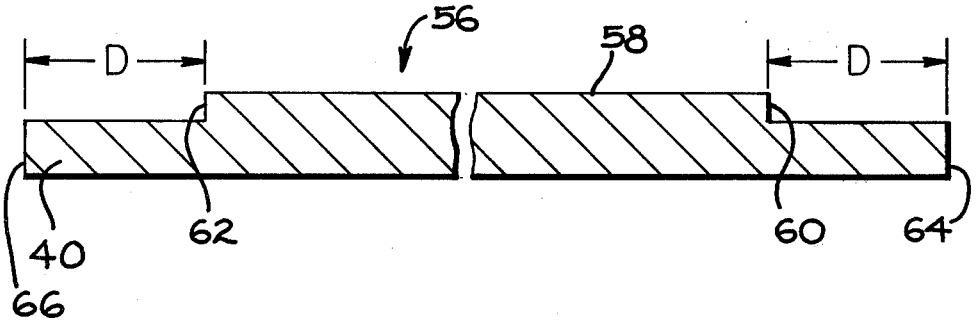
FIG. 4 is a cross-sectional view taken generally along the line IV—IV of FIG. 3.

Referring to FIGS. 3 and 4, the sleeve 40 also includes means 56 for maintaining the sleeve 40 against axial movement along the spring pin 36. The means 56 includes a protrusion 58 which extends radially outwardly from the first surface 42 of the sleeve 40 and is adjacent the key portion 48. As is evident from FIG. 4, the protrusion 58 does not extend the full length of the sleeve 40 and stops short of each end of the sleeve 40 by generally the same distance. The distance "D" between the ends 60 and 62 of protrusion 58 and the ends 64 and 66 of sleeve 40 is slightly less than the thickness of the walls 52 and 54 of the tool 14. In view of this, the protrusion 58 will fit within cavity 32 and span the distance between walls 52 and 54 in order to keep the sleeve from moving axially along the pin during installation of the pin assembly 16.

Figure 5:
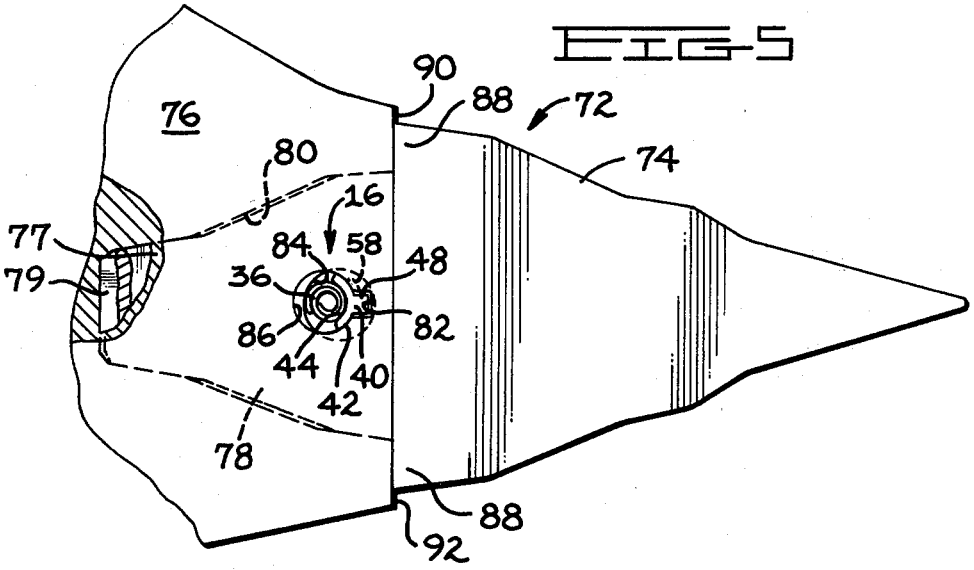
FIG. 5 is a diagrammatic side elevational view of an alternate embodiment of the present invention.

Referring to FIG. 5, an alternate embodiment of the invention is shown. In this embodiment, an earthworking apparatus 72 includes a tool 74 which is mounted to a supporting member 76 by means of a rear mounting portion 78 which fits within a cavity 80 formed within the supporting member 76. This mounting relationship is the reverse of the mounting relationship of the previous embodiment which has been described. In this alternate embodiment, the retaining pin assembly 16 is identical with that of the first embodiment. However, in view of the reversal of the mounting relationship between the tool 74 and the supporting member 76, the parts of the pin assembly have also been reversed. The key portion 48 of the sleeve 40 now fits within slots 82 formed in the walls 77,79 of the supporting member 76. Also, the spring pin 36 is now compressed between the second surface 44 of the sleeve 40 and a pin receiving opening 84 in the tool 74. Resistance to the force of the spring pin 36 when it is compressed is also taken through the contact of the first surface 42 of the sleeve 40 and the walls of the pin receiving openings 86 formed in the supporting member 76.

When the tool 74 is in the installed position with the rear mounting portion 78 within the cavity 80, and the retaining pin assembly 16 is assembled within the pin receiving openings 84 and 86, the tool 74 is seated against the supporting member 76 such that an end portion 88 of the tool 74 is in contacting relationship with shoulders 90 and 92 of the supporting member.

INDUSTRIAL APPLICABILITY

The subject retaining pin assembly 16 is particularly useful for locking an earthworking tool 14 to a supporting member 12, such as a shank of a rockbreaking apparatus. The retaining pin assembly 16 also functions to force end portion 28 of the tool 14 into contacting relationship with the shoulders 18 and 20 of the supporting member 12, and to hold such members in forceful contact. It is important that the tool 14 fit tightly on the supporting member 12 and that axial forces applied to the tool 14 are transferred into the supporting member 12 through the contact of end portion 28 with shoulders 18 and 20. If the tool 14 does not fit tightly on the supporting member 12, energy transfer, between the tool 14 and the supporting member 12, will be reduced during an earthworking operation. In addition, the energy loss can be absorbed in heat, which can cause loss of strength in the working parts.

In operation, the tool 14 is fitted to the supporting member 12 such that the nose portion of member 12 penetrates the cavity 32 and the pin receiving openings 22 and 30 are generally aligned, although non-coaxial. Sleeve 40 is then inserted into openings 22,30 and key portion 48 is seated within slot 50. In this position, protrusion 58 spans the distance between walls 52 and 54 and ends 60 and 62 fit closely adjacent the inner surfaces of walls 52 and 54. Spring pin 36 is then held in position adjacent the sleeve 40 and pin openings 22,30 and is struck with a hammer or other tool to force the pin 36 into the openings 22,30. Since the pin 36 is larger in its uncompressed state than the space presented between surface 44 of the sleeve 40 and the pin opening 22, the pin is forced to compress as it is driven into the openings 22,30. Continuous blows are applied to the pin 36 until it is driven completely into the openings 22,30 and the ends of the pin 36 are generally flush with the outside surfaces of the tool 14.

As the pin 36 is forceably driven into the openings 22,30 and is compressed, a force is developed between the pin 36 and the pin opening 22 on one side and between the pin 36 and the sleeve 40 on the opposite side. The force applied through the sleeve 40 is transferred into the tool by way of the surface 42, which is in contact with the pin opening 30. Since the pin opening 22 is in the support member, which is more massive than the tool, the force applied to the pin opening 30 through the pin 36 and the sleeve 40 forces the tool toward the supporting member until the end portion 28 abuts the shoulders 18 and 20. In prior art pin retaining arrangements, it would be necessary to machine the end portions 28 to assure good contact with the shoulders 18 and 20. The subject retaining pin assembly, however, provides sufficient force to allow as cast, or as forged, surfaces for the end portions 28.

As the pin 36 is being driven into the openings 22,30, an axial force is developed between the pin 36 and the sleeve 40. Such a force would normally displace the sleeve 40. However, the protrusion 58, which fits between the walls 52 and 54 of the tool, prevents axial displacement of the sleeve. When the pin 36 is driven out of the openings to remove the tool 14, the protrusion 58 functions in a similar manner to resist displacement of the sleeve 40.

During an earthworking operation, the tool 14 and the supporting member 12 are subjected to rapid impact loads. Such loads cause severe vibrations in the earthworking apparatus 10 and, in prior art apparatus, have caused rotation of the retaining means within the pin openings. In the present invention, the key portion 48 cooperates with the slot 50 to prevent rotation of the sleeve 40, and thereby ensures that the pin 36 remains compressed. As long as the pin 36 remains compressed, a force is applied to the tool 14 to keep it in contact with the supporting member 12.

Other aspects, objects and advantages of this invention can be obtained from a study of the drawings, the disclosure, and the appended claims.

I claim:

1. In an earthworking apparatus (10) having a tool supporting member (12) having shoulders (18,20) and an earthworking tool (14) having first and second end portions (26,28) and being releasably secured to said supporting member (12), said supporting member (12) and tool (14) each having a pin receiving opening (22,30) and being insertable one within the other with the pin opening (22,30) of each being generally aligned in the installed position of the tool (14) and the supporting member (12), and a pin (36) insertable through said openings (22,30) and connecting the tool (14) to the supporting member (12), the improvement comprising:

said pin (36) having an outer surface (38) and being of a spring type configuration;

said pin openings (22,30) of the supporting member (12) and the tool (14) being non-coaxial in the installed position of the tool (14) and the supporting member (12) with said second end portion (28) of the tool (14) in contacting relationship with said shoulders (18,20) of the supporting member (12);

a sleeve (40) having first and second surfaces (42,44), each of arcuate configurations, said sleeve (40) being positioned in the openings (22,30) of the supporting member (12) and tool (14) with said first surface (42) in forceable contact with one of the tool (14) and supporting member (12), and said second surface (44) in forceable contact with the outer surface (38) of said spring pin (36) in the installed position of the tool (14) and the supporting member (12), with the pin (36) extending through the openings (22,30) with one side of the outer surface (38) of said pin (38) in forceable contact with one of the supporting member (12) and tool (14) and the opposed side of the outer surface (38) of said pin (36) in forceable contact with the sleeve (40); and means (46) for maintaining said sleeve (40) against rotation about the pin (36).

2. The improvement, as set forth in claim 1, wherein said means (46) includes a key portion (48) formed on said first surface (42) of said sleeve (40) and a slot (50) formed in one of said tool (14) and said supporting member (12).

3. The improvement, as set forth in claim 2, wherein said key portion (48) extends the full length of said sleeve (40).

4. The improvement, as set forth in claim 3, wherein said tool (14) includes first and second walls (52,54) and each wall (52,54) contains a slot (50).

5. The improvement, as set forth in claim 3, wherein said support member (12) includes first and second walls (77,79) and each wall contains a slot (82).

6. The improvement, as set forth in claim 1, including means (56) for maintaining said sleeve (40) against axial movement along said pin (36) as said pin (36) is inserted through said openings (22,30).

7. The improvement, as set forth in claim 6, wherein said means (56) includes a protrusion (58) formed on said first surface (42) of said sleeve (40).

8. The improvement, as set forth in claim 1, wherein said sleeve (40) encompasses between one-third to two-thirds of said outer surface (38) of said pin (36).

9. The improvement, as set forth in claim 8, including a protrusion (58) formed on said first surface (42) of said sleeve (40) for maintaining said sleeve (40) against axial movement along said pin (36) as said pin (36) is inserted through said openings (22,30).

10. A retaining pin assembly (16) for releasably securing an earthworking tool (14) having a pin receiving opening (30) and first and second end portions (26,28) to a support member (12) having a pin receiving opening (22) and shoulder portions (18,20) and for maintaining said second end portion (28) of said tool (14) in contacting relationship with said shoulder portions (18,20) of said support member (12), comprising:

a pin (36) having an outer surface (38) and being of a spring type cylindrical configuration;

a sleeve (40) having first and second surfaces (42,44), and a protrusion (58) formed on said first surface (42), with said first surface (42) being of a configuration for contacting one of said pin receiving openings (22,30), and said second surface (44) being of a configuration for contacting said pin (36); and means (46) for maintaining said sleeve (40) against rotation about said pin (36).

* * * * *